US006083593A

United States Patent [19]

LaLande et al.

[11] Patent Number: 6,083,593

[45] Date of Patent: Jul. 4, 2000

[54] MULTIPLE PLY DOCUMENT ASSEMBLY AND PRODUCTION THEREOF

[75] Inventors: Jean Claude LaLande, Colchester; Peter Merriell Kvam, S. Burlington, both of Vt.

[73] Assignee: Bertek Systems, Inc., Cincinnati, Ohio

[21] Appl. No.: 09/074,007

[22] Filed: May 7, 1998

[51] Int. Cl.[7] ..... G09F 3/00

[52] U.S. Cl. ..... 428/42.2; 283/81; 428/41.8; 428/42.1; 428/43; 428/913.3; 428/914

[58] Field of Search ..... 428/40.1, 41.8, 428/41.7, 42.1, 42.2, 42.3, 43, 352, 354, 913.3, 914; 282/81

[56] References Cited

U.S. PATENT DOCUMENTS

| | | | |
|---|---|---|---|
| 4,609,589 | 9/1986 | Hosoda | 428/352 |
| 4,747,619 | 5/1988 | Sager | 428/42.1 |
| 5,766,401 | 6/1998 | Campbell | 428/345 |
| 5,827,609 | 10/1998 | Ercillo | 428/354 |

*Primary Examiner*—Nasser Ahmad
*Attorney, Agent, or Firm*—Thomas N. Neiman

[57] ABSTRACT

The present invention is directed to a variably imaged document, such as a permit or license which is a multiple layered form or label construction that can be attached to a window or any translucent surface. The multiple layered form or label assembly is constructed of two separate material combinations laminated together. A variably imaged receptive pressure sensitive stock is used in one combination and a pressure sensitive plastic film stock is used in the other and the two combinations are laminated together to form the multiple layered construction using adhesives and patterns of release coatings. The assembly is die cut in a fashion that allows the removal of the center laminated portion that carries the variable information for the license or permit and is die cut in a manner that provides the adhering of the document to the inside of the window via the pressure sensitive adhesive on the exposed perimeter of the transparent plastic film. A method of producing the multiple ply document assembly is also disclosed.

7 Claims, 4 Drawing Sheets

MULTIPLE PLY DOCUMENT ASSEMBLY AND PRODUCTION THEREOF

BACKGROUND OF THE INVENTION

This invention pertains to documents, and in particular, to a multiple ply document assembly that is designed to allow the user to attach the variably imaged document, such as a permit or license to the inside of a window or any translucent surface and ,at the same time allow a portion of the assembly to be imaged and attached to accompanying paperwork or documents. A method of producing the multiple ply document assembly is also disclosed.

There are many known uses for an assembly which will permit the user to position a document, such as a permit or license or the like on the inside of a window. A number of different labels are designed to be affixed to accompanying documents. What is needed is a multiple ply document assembly that will provide a unit which provides a document that employs the combination of a variably imaged license or permit that can be applied to the inside of a window and the design must allow the document to be imaged through a printer and then removed from the assembly and applied to the inside of a window. Past combinations call for the center portion to be easily released from the affixing layer, causing potential jamming of the printer applying the variable data. What has not been done in this area is a multiple ply document assembly which firmly adheres the center die cut portion to a pressure sensitive face stock and, at the same time, provides a fully coated receipt label that allows a secure bond to paper work that accompanies the processing of the permit or license. What is needed is a multiple ply document assembly that can easily and effectively be printed on current printing equipment.

Clearly, it is desirable for an item of this type to be very adaptable. At the same time, the item should be easy to manufacture and be produced of cost effective material. It is the object of this invention to set forth a multiple ply document assembly which avoid the disadvantages and previously mentioned limitations of typical current document assemblies.

SUMMARY OF THE INVENTION

Particularly, it is the object of this invention to teach a multiple ply document assembly, for use in providing a license or permit with a variably imaged surface that can be applied to the inside of a window or translucent surface, said structure comprising a multiple ply document assembly comprising a first means of a combined construction and a second means of a combined construction; said first means of a combined construction comprises a sheet of facestock material having a top side and a bottom side; said sheet of facestock material having a layer of adhesive positioned of said bottom side of said facestock material; said first means of said combined construction further comprising a sheet of liner material attached to said bottom side of said sheet of facestock material; said sheet of liner material having release coated means positioned on both faces of said sheet of liner material; said second means of said combined construction comprising a sheet of plastic film facestock material; said sheet of plastic film facestock material having a pressure sensitive adhesive side positioned toward the center of said combined construction; said second means of said combined construction further comprising a secondary removable liner positioned between said first means of said combined construction and said second means of said combined construction; and said second means of said combined construction further having a coating of release agent positioned between said secondary removable liner material and said pressure sensitive adhesive side of said plastic film face stock material in order to allow said secondary removable liner to be delaminated and discarded during the production process. Also, it is the object of this invention to teach a multiple ply document assembly, for use in providing a license or permit having a variably imaged surface that can be applied to the inside of a window or any translucent surface, comprising in combination a multiple ply document assembly comprising a base sheet of facestock material and a sheet of liner material being adhered together forming first means of combined construction, said base sheet of facestock and said sheet of liner material having a front side and a rear side; at least one side of said base sheet having areas of adhesive coating thereon and both sides of said sheet of liner material having areas of release material coated thereon; said multiple ply document assembly further comprising a secondary removable liner material having an adhesive layer positioned thereon; wherein areas of said secondary removable sheet of liner material being replaceably connected with areas of said base sheet of facestock material when said first means of combined construction and said second means of combined construction being laminated together.

It is also the object of this invention to teach a method of producing a multiple ply document assembly, for use in providing a license or permit having a variably imaged surface to be applied to the inside of a window or any translucent surface, said method comprising the steps of providing a plurality of sheets of material, each of said sheets having a front side and a rear side, said sheets of material having a precoated layer of adhesive on at least one side of said sheets of material, each of said sheets having a liner; printing information on the front side of said first sheet of material; providing one of said sheets of material with a layer of silicone on the back of the material; printing information on the second sheet of material; delaminating said liner from said second sheet of material; laminating said sheets of material together; cutting said sheets of material as desired in order to form the multiple ply document assembly for being able to apply a license or permit on the inside of a window; and stripping away excess material.

BRIEF DESCRIPTION OF THE INVENTION

Further objects and features of this invention will become more apparent by reference to the following description taken in conjunction with the following figures, in which.

DESCRIPTION OF THE PREFERRED EMBODIMENTS

Figure 1:
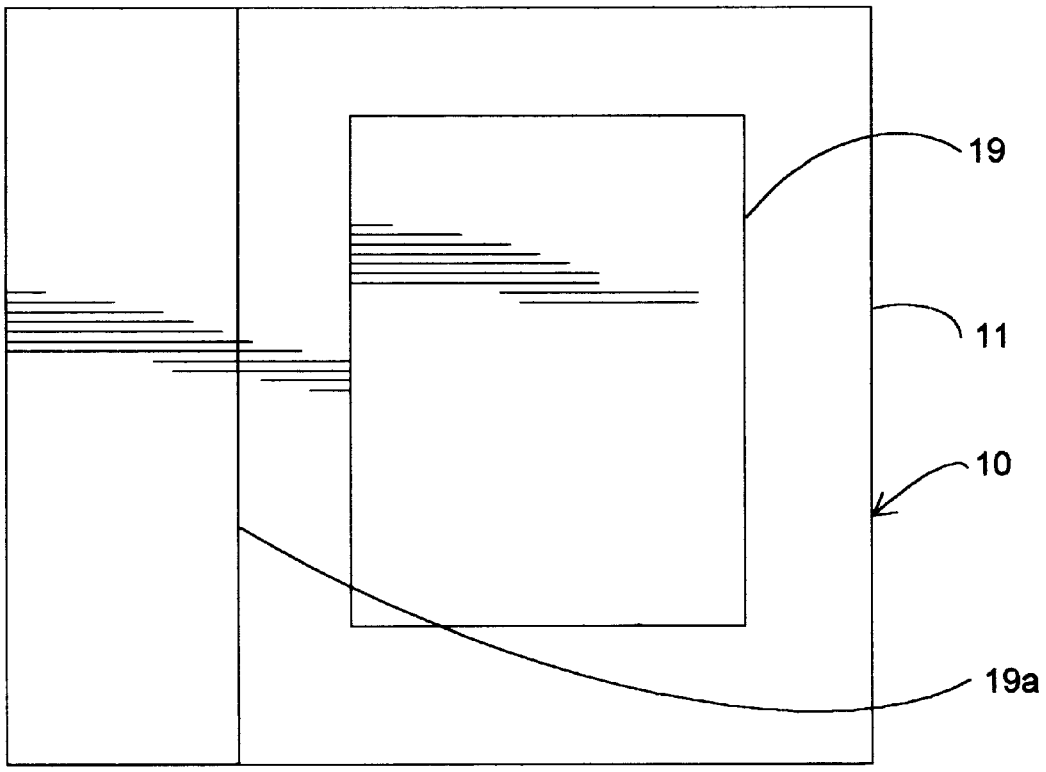
FIG. 1 is a top plan view of the multiple ply document assembly showing finished document.
Figure 4:
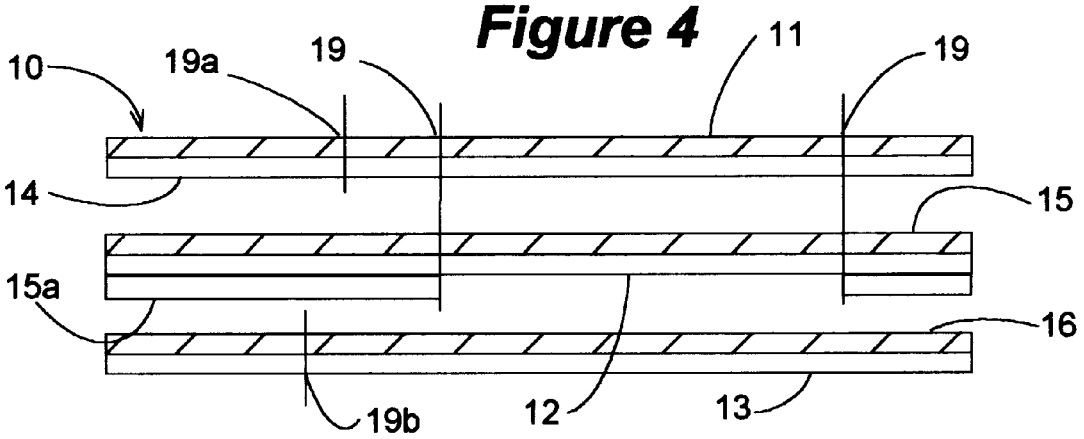
FIG. 4 is a cross sectional view of the preferred embodiment of the completed construction of the multiple ply document assembly.
Figure 2:
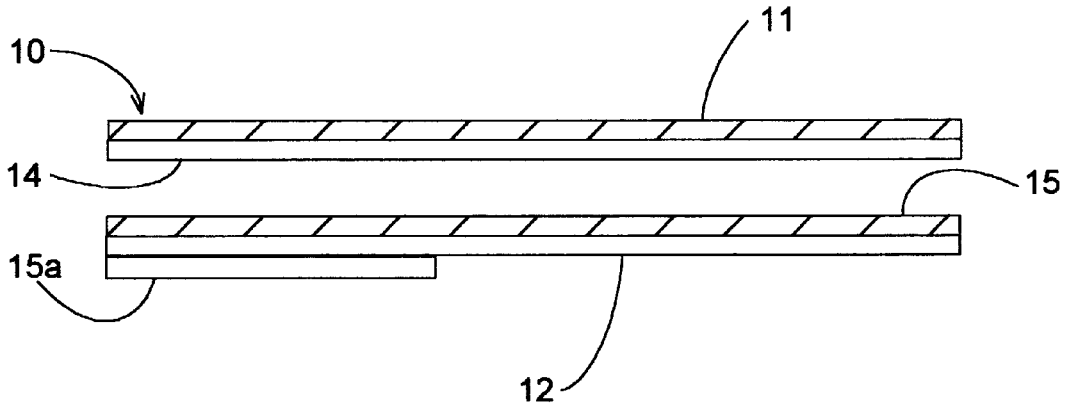
FIG. 2 is a cross sectional view of the first means of combined construction.
Figure 3:
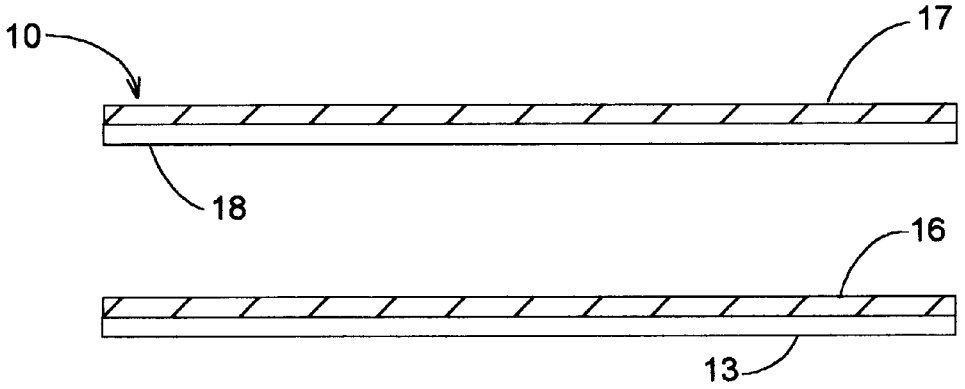
FIG. 3 is a cross sectional view of the second means of the combined construction.
Figure 5:
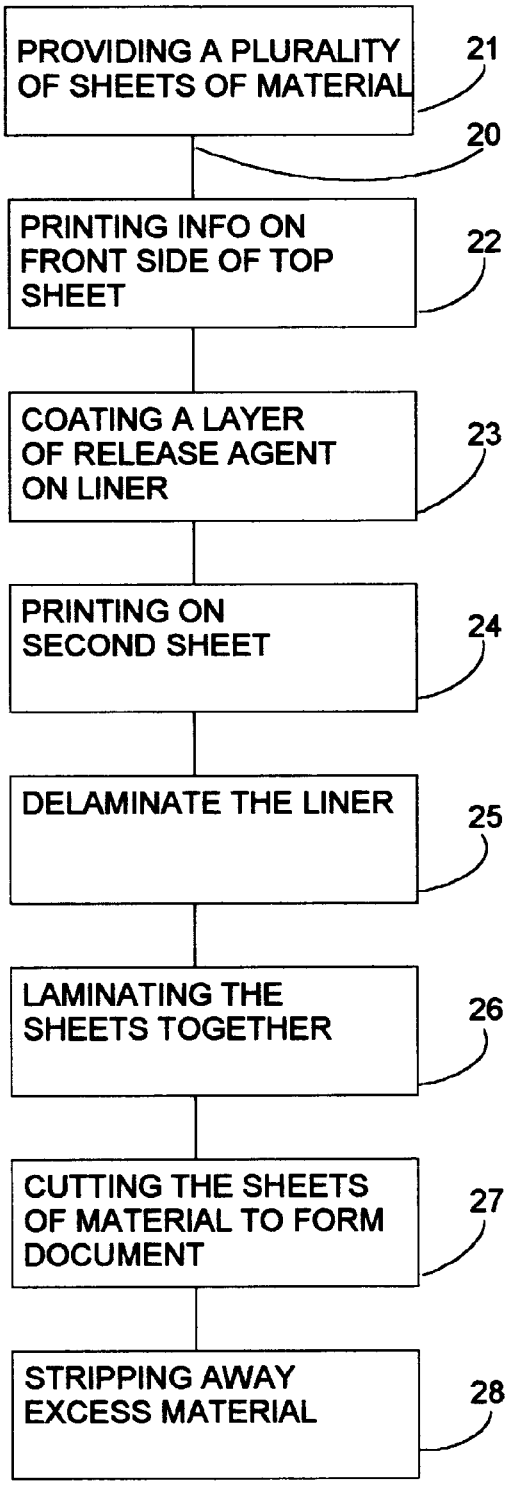
FIG. 5 is a block diagram of the method of producing a multiple ply document.
Figure 7:
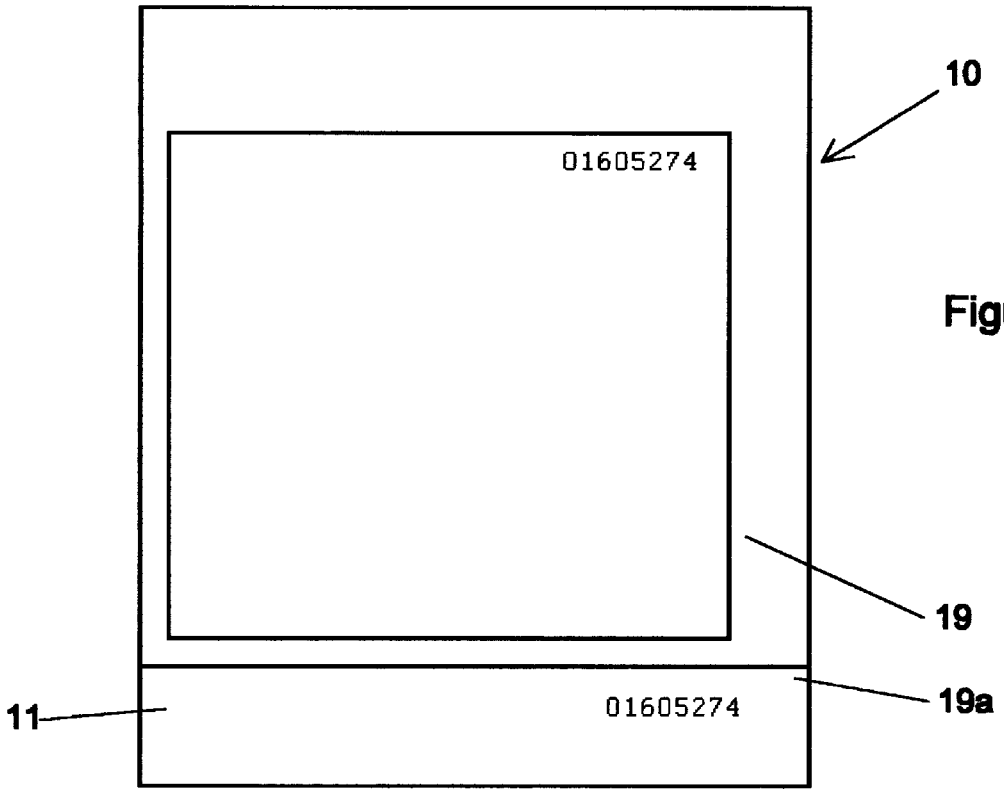
FIG. 7 is a top plan view of a finished document thereof.
Figure 6:
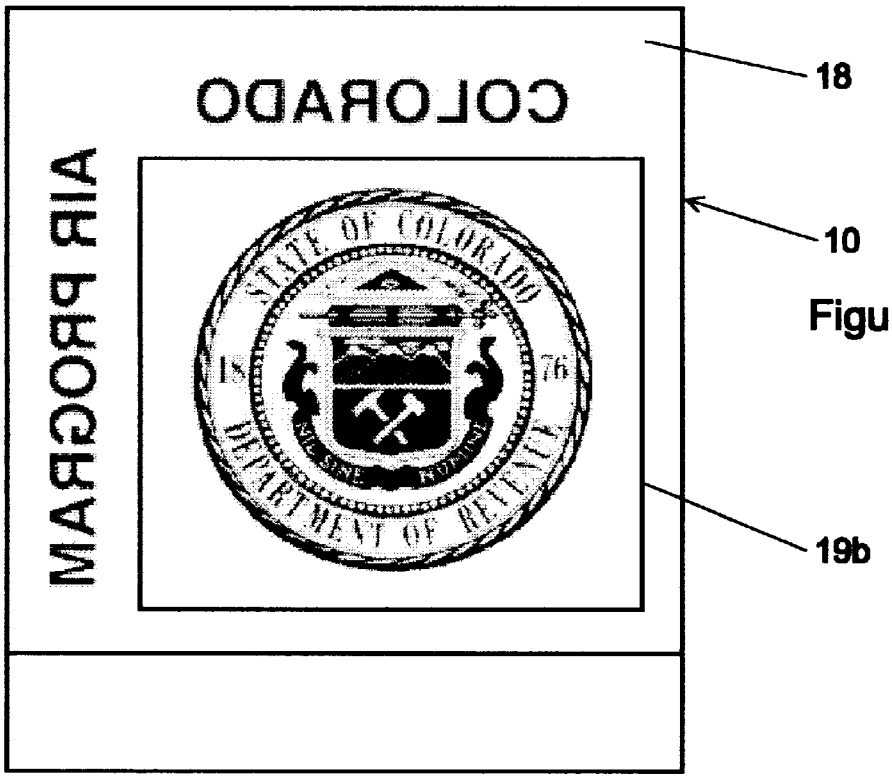
FIG. 6 is a bottom plan view of a finished document assembly.

As shown in the figures, the novel multiple ply document assembly 10 comprises a unit of first means of combined construction which is comprised of a base facestock sheet 11 having a front side and a rear side. The facestock sheet 11 can be constructed of cellulose or plastic film pressure sensitive material and is designed to function as the permit or license. A liner sheet 12 which is the liner of the base sheet pressure sensitive material is provided having a front side and a rear side. A release agent 15 and 15*a* is positioned on both sides of the liner sheet 12 and an adhesive layer 14 is positioned (or is precoated) on the rear side of the facestock sheet 11 between the middle liner sheet 12 and the facestock sheet 11.

The second unit of combined construction is comprised of a second sheet 13 of plastic film is positioned below a removable secondary sheet of the liner material 17. The plastic film 13 has a precoated pressure sensitive layer of permanent adhesive 16 is positioned against the removable sheet of liner material 17 having a release coating 18 that will be discarded when the assembly 10 is laminated together and then die cut and the excess material removed. The secondary removable liner material 17 is removed during the delamination process. The second sheet 13 laminated to the primary liner 12 are die cut so as to produce a license or permit. The finished document is designed to be installed on the inside of a window or any translucent surface and, at the same time, provides a fully coated receipt label that allows for a secure bond to paper work accompanying the processing of the permit or a license. This is accomplished by die cutting the center laminated portion so that the document can be removed and attached to the inside of a window because of the exposed pressure sensitive adhesive on the exposed perimeter of the third sheet 13 of plastic film.

There are a plurality of die cuts; the first is a die cut 19 around the center area through the first sheet of material through the adhesive layer to the clear film of the second sheet. The second die cut 19*a* goes through the face stock and the adhesive and stops at the liner of the first sheet of material to create an auxiliary label for paperwork purposes. The third die cut 19*b* cuts the perimeter through the plastic film to the back side of the liner to remove the center portion in order to permit the document has a full perimeter seal against the window. Excess material is then stripped away from the assembly and the assembly is then fan folded for future use in a computer printer.

The novel method 20 of producing a multiple ply document assembly comprises the following steps: providing a plurality of sheets of pressure sensitive material, each of said sheets having a front side and a rear side, said sheets of material having a precoated layer of adhesive on at least one side of said sheets of material, each of said sheets having a liner 21; printing information on the front side of said top sheet of material 22; providing on of said sheets of material with a layer of release coating on the back of said material in selected areas 23; providing one of said sheets of material with a layer of release coating 24; delaminating the liner from said assembly 25; laminating said plurality of sheet of material together 26; cutting of said sheets of material as desired in order to form a multiple ply document assembly for being able to apply a license or permit on the inside of a window 27; and stripping away excess material 28. The multiple ply document assembly is then fan folded for future use in a computer printer.

The multiple ply document assembly is constructed and designed for a unique purpose. Having the release agent, such as silicone positioned over the middle liner sheet (or providing a precoated liner sheet) provides for easy removal of the finished document from the middle liner sheet and allows the document which has been variably imaged printed on the top side of the facecoat sheet to be attached to the inside of a window. The multiple ply document assembly is far superior to the use of other document labels in that other units can have the center portion delaminate from the rest of the construction. The delamination can occur during the processing through a computer printer or during the application of the document to the window. Either would create problems for the user.

While we have described our invention in connection with specific embodiments thereof, it is clearly to be understood that this is done only by way of example and not as a limitation to the scope of our invention as set forth in the objects thereof and in the appended claims.

We claim:

1. A multiple ply document assembly, for use in providing a license or permit with a variably imaged surface that can be applied to the inside of a window or any translucent surface, comprising:

a multiple ply document assembly comprising a first means of a combined construction and a second means of a combined construction;

said first means of a combined construction comprises a sheet of facestock material having a top side and a bottom side;

said sheet of facestock material having a layer of adhesive positioned of said bottom side of said facestock material;

said first means of said combined construction further comprising a sheet of liner material having front and back faces and attached to said bottom side of said sheet of facestock material by its front face;

said sheet of liner material having release coated means positioned on both faces of said sheet of liner material;

said second means of said combined construction comprising a sheet of plastic film facestock material;

said sheet of plastic film facestock material having a pressure sensitive adhesive side positioned toward the center of said combined construction;

said multiple ply document assembly comprises a design formed by a plurality of predetermined die cuts containing:

an initial die cut comprises cutting the center area of said sheet of facestock material and cutting through said sheet of facestock material and said sheet of liner material to said adhesive on said sheet of plastic film facestock material;

a second die cut lines comprises cutting through said sheet of facestock and an adhesive layer to said liner material, said second die cut line extending edge-to-edge across the first means of combined construction thereby creating an auxiliary label for the paperwork purposes; and a tertiary die cut comprises a cut through and around the inside of perimeter of said sheet of plastic film to said back face of said liner material for creating the mechanism for removing the center portion of said assembly in order to create a perimeter seal for said document, the tertiary die cut is offset outwardly from the initial die cut and the second die cut.

2. A multiple ply document assembly, according to claim 1 wherein;

said sheet of facestock material comprising variable imaging receptive material.

3. A multiple ply document assembly, according to claim 1, wherein:

said sheet of facestock material comprises a document of cellulose material.

4. A multiple ply document assembly, according to claim 1, wherein:

said sheet of liner material comprises a document of plastic material.

5. A multiple ply document assembly, according to claim 1, wherein:

said layer of adhesive material on said bottom side of said facestock material comprises the use of pressure sensitive adhesive.

6. A multiple ply document assembly, according to claim 1, wherein:

said release coating on both sides of said sheet of liner material comprises the use of silicone thereon positioned selectively in areas on the back side of said sheet of liner material.

7. A multiple ply document assembly, according to claim 1, wherein:

said sheet of plastic film facestock material comprises a sheet of transparent plastic construction having a pressure sensitive adhesive coated side.

* * * * *